United States Patent [19]

Boadway

[11] 4,389,307

[45] Jun. 21, 1983

[54] ARRANGEMENT OF MULTIPLE FLUID CYCLONES

[75] Inventor: John D. Boadway, Kingston, Canada

[73] Assignee: Queen's University at Kingston, Kingston, Canada

[21] Appl. No.: 275,987

[22] Filed: Jun. 22, 1981

[51] Int. Cl.[3] ..... B04C 5/28

[52] U.S. Cl. ..... 209/211; 210/512.2

[58] Field of Search ..... 209/144, 211; 210/512.2; 137/809; 55/346, 349, 459R, 461

[56] References Cited

U.S. PATENT DOCUMENTS

| | | | |
|---|---|---|---|
| 2,532,885 | 12/1950 | Berges | 209/211 |
| 3,415,373 | 12/1968 | Pink et al. | 209/211 X |
| 3,458,237 | 7/1969 | Noe | 137/809 X |
| 3,613,887 | 10/1971 | Wikdahl | 209/211 |
| 3,948,771 | 4/1976 | Bielefeldt | 209/211 X |
| 4,001,121 | 1/1977 | Bielefeldt | 209/211 X |

FOREIGN PATENT DOCUMENTS

| | | | |
|---|---|---|---|
| 149985 | 2/1937 | Austria | 209/144 |

*Primary Examiner*—Ralph J. Hill

*Attorney, Agent, or Firm*—Stanley E. Johnson; Richard J. Hicks

[57] ABSTRACT

A special form of fluid cyclone in which the velocity energy in the exit fluid is converted into exit pressure thus permitting the device to discharge to atmospheric pressure or a higher pressure while a vacuum may exit in the central core of the vortex. The result is achieved by use of a curved passage at the exit which starts as a coaxial space and gradually expands and turns outward to become a circular space between two disks. The removal of reject material to atmospheric pressure with a vacuum at the core may be achieved by limiting the restriction in cross-section of the bottom core such that the pressure is atmospheric and allow it to leave through a space between the end of the cone and a blunt shaped surface. The above special form of fluid cyclone operates particularly well, because of reduced energy losses, when employed in a multiple arrangement in which the tangential velocity energy of fluid entering the barrel of the individual cyclone units is created by fluid flowing at larger radius such as to create a pattern of multiple vortex flow. The vortices are in a chamber providing a common inlet to a plurality of cyclone units with the vortices centering on the individual units. The special arrangement of fluid cyclones is in a geometry similar to that of a vortex trail with an even number of units of opposing vortex direction. The same type of arrangement; i.e. having all of the units discharge into a common chamber, leads to further energy recovery in fluid leaving the fluid cyclones.

17 Claims, 13 Drawing Figures

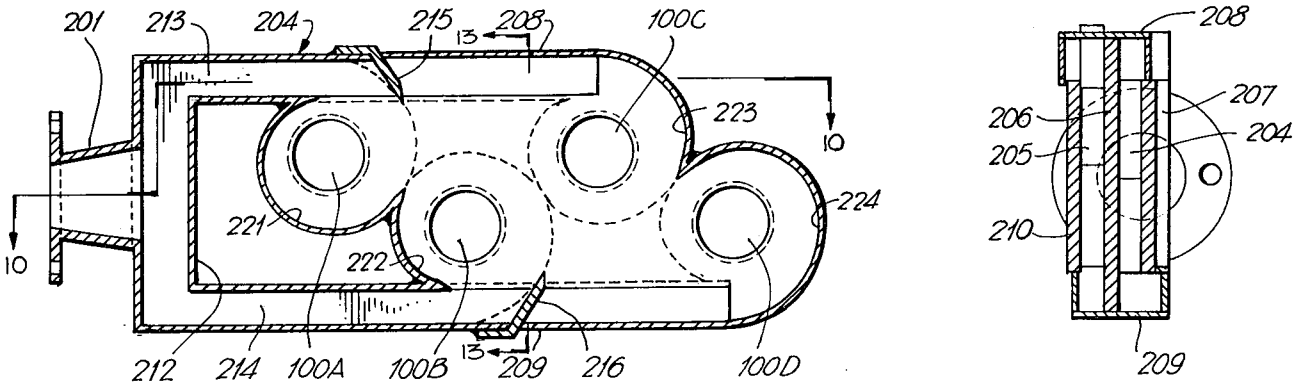
Fig. 11
Fig. 13
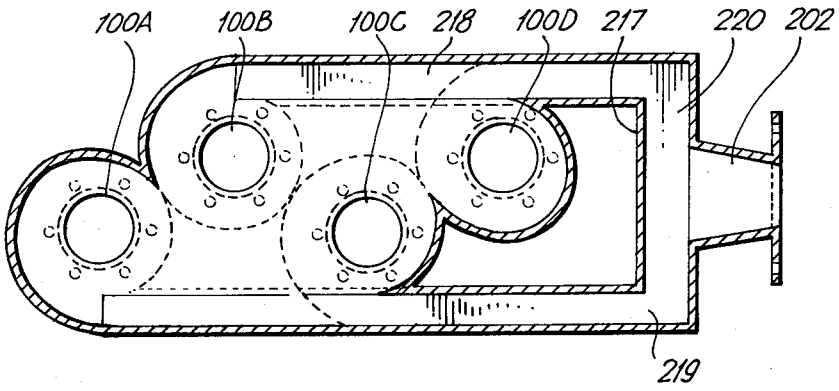
Fig. 12

ARRANGEMENT OF MULTIPLE FLUID CYCLONES

This invention relates to a special form of fluid cyclone in which the velocity energy in the exit fluid is converted into exit pressure thus permitting the device to discharge to atmospheric pressure or a higher pressure while a vacuum may exist in the central core of the vortex.

This invention also relates to a special arrangement for multiple fluid cyclones which operate with less energy due to recovery of the energy in the fluid as it leaves the device.

The principles of the invention may be applicable, where the fluid is a liquid or a gas and permits removal of solid or liquid particles of higher density than the main fluid.

Fluid cyclones and Hydroclones have been in use for some time by the paper industry and metallurgical industry. These devices are described in the textbook "Hydroclones" written by D. Bradley and published by the Pergamon Press.

The most common form of Hydroclone is the straight conical design. Fluid enters by a tangential inlet into a short cylindrical section. A vortex is created in the cylindrical section and a conical section below the cylindrical section as fluid spirals in a path moving downward and inward, then upward in a helical path to an exit pipe co-axial with the cylindrical section. The centrifugal acceleration, due to rapid rotation of the fluid, causes dense particles to be forced outward to the wall of the cylinder and cone.

The dense particles are transported in the slower moving boundary layer downward towards the apex of the cone where they leave as a hollow cone spray. The high centrifugal force near the centre opens up a liquid free space which is referred to as a vortex cone. In the conical cylone, with free discharge of rejects to the atmosphere, this core is filled with air and a back pressure at the exit of the hydroclone is required to prevent air insuction.

In some designs the cylindrical section is much longer than in others. One design having a longer cylindrical section is sold under the trade name "Vorvac" which was designed to remove both dirt and gas simultaneously. The general flow pattern is similar to that described for conical designes, but there is an additional downward moving helical flow next to the core carrying froth or light material. This extra flow is obtained because of the use of a device at the exit which will be discussed later and referred to as a core trap. The reject flow from the Vorvac is usually to a vacuum tank and the entire fluid in the device is below atmospheric pressure in order to expand gas bubbles so they can be taken out more readily.

Another known device sold under the trade name "Vorject" has a conventional type of fluid flow pattern, but the conical reduction at the bottom is used to turn back the main downward flows towards the main fluid exit, but not to limit discharge of reject flow. The boundary layer fluid containing the reject material is separated from the rest of the fluid nearer the centre by use of a core trap and its issues forth from a tangential exit under pressure. The rejection of material and prevention of air insuction in this type of design is not affected by outlet pressure. Rejection of material may be controlled by throttling of the reject stream and may also be limited by injection of water to carry back fine material while removing coarser material.

Various designs of fluid cyclones and other vortex separators are disclosed in the following U.S. Pat. Nos: 2,982,409, 2,849,930, 2,816,490, 2,757,581, 2,920,761, 2,757,582, 2,927,693, 2,835,387, 3,785,489, 3,734,288, 3,716,137, 3,696,927, 3,612,276, 3,101,313, 3,421,622, 3,543,932, 3,861,532, 3,057,476, 3,353,673, 3,288,286.

The fluid leaving a fluid cyclone has a very high tangential velocity about the central axis and quite a high axial velocity. In most designs this velocity energy becomes dissipated as turbulence in the exit piping.

A principal object of the present invention is to provide a modified design for the recovery of energy in the fluid which in previous designs was lost.

Where multiple small units are used they are usually assembled into some form of bank. The past method used headers with individual connectors and more recent arrangements involve placing multiple units in tank like systems. In both these systems nozzles or slots provide a throttling means to ensure distribution of the flow and a tangential entry velocity to the individual units.

A further object of the present invention is to provide a special arrangement for multiple cyclones which operate with less energy due to recovery of the energy in fluid as it leaves the device.

A further object of the present invention is to provide a special arrangement for multiple cyclones which leads to reduced energy loss in creating the tangential velocity upon entering the fluid cyclones, thereby leaving more energy to be recovered on exit from each individual cyclone. In addition, the same special arrangement at the exit leads to more complete recovery of velocity energy in fluid leaving the individual cyclones.

In keeping with the foregoing there is provided in accordance with one aspect of the present invention a fluid cyclone having an upper cylindrical end portion with inlet and outlet passages tangential thereto, said outlet passage having an annular inlet in the cylindrical portion and coaxial therewith followed by an inner passage that gradually increases in area and diameter to the tangential outlet passage and a lower portion with a reject outlet in the lower end thereof.

In accordance with a further aspect of the present invention there is provided a header for a plurality of cyclones, said header having a passageway with a first inlet thereto and a plurality of outlets therefrom, said outlets being spaced apart from one another downstream from said first inlet and providing inlets to respective ones of the plurality of cyclones; and deflector means in said passageway to create vortices of flowing fluid at each of said plurality of outlets.

In accordance with a further aspect of the present invention, where a plurality of cylones are to be supplied with fluid, their tangential velocity may be provided by a multiple vortex pattern established between two plates with the centre of the multiple vortices centered on the axis of the cyclones. In a similar manner a reverse flow of vortices may be obtained in a separate space between two plates. This is best done with an equal number of fluid cyclones half of which rotate clockwise and with inflow to the vortices between the parallel plates, and exit from the parallel plate on one side of the bank of cyclones whereas the other half of the fluid cyclones rotate in a counterclockwise direction and receive and discharge their flows to vortices between the plates from and to a channel on the other side of the bank of cyclones. A set of deflector plates may be used on the inlet channels to the vortex space to insure proper formation of the vortex pattern by directing flow at the proper orientation towards the vortex about each cyclone.

The invention is illustrated by way of example in the accompanying drawings wherein:

FIG. 11 is a cross-sectional view taken along stepped sectional line 11—11 in FIG. 9;

FIG. 12 is a cross-sectional view taken along stepped sectional line 12—12 in FIG. 9;

FIG. 13 is a cross-sectional view taken along sectional lines 13—13 in FIGS. 9 and 11.

Figure 1:
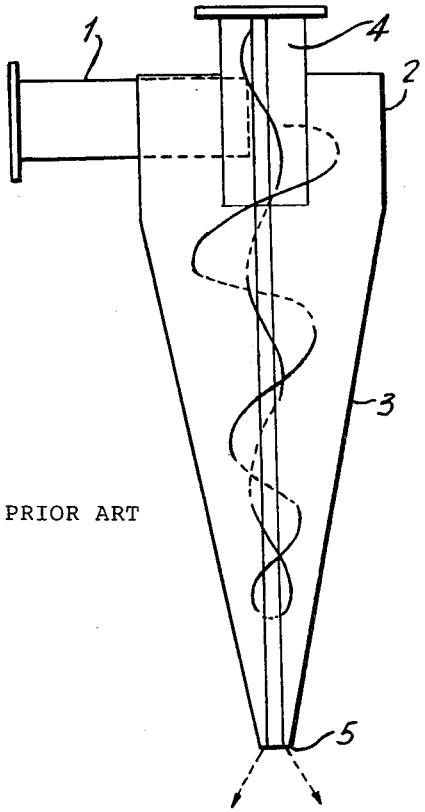
FIG. 1 is an elevational view of a typical cone type fluid cyclone.

Referring now in detail to the drawings, there is illustrated in FIG. 1 the most common form of hydrocyclone which is a straight conical design. Fluid enters by a tangential inlet 1, into a short cyclindrical section 2. A vortex is created in the cylindrical section and a conical section 3 below the cylindrical section as fluid spirals in a path moving downward and inward, then upward in a helical path to an exit pipe 4 co-axial with the cylindrical section. The centrifugal acceleration due to rapid rotation of the fluid causes dense particles to be forced outward to the wall of the cylinder and cone. The dense particles are transported in a slower moving boundary layer downward toward the apex 5 of the cone where they leave as a hollow cone spray. The high centrifugal force near the center opens up a fluid free space which is referred to as the vortex core when the fluid is a liquid. In the conical cyclone, with free discharge of rejects to atmosphere, this cone is filled with air and a back pressure at the exit of the hydrocyclone is required to prevent air insuction.

The present invention is directed to reducing energy losses caused by friction in fluid cyclones. In considering energy states in a fluid cyclone, at the inlet to the fluid cyclone the hydraulic energy in the fluid is mostly pressure with some as velocity.

In the descending path, as the fluid spirals inward towards the smaller radius of exit, velocity increases roughly according to the relationship $V_\theta = kr^n$. If there were no friction n would have a value of $-1$, but because of friction n lies somewhere between $-0.4$ and $-0.9$ depending on design. In this region pressure energy goes down as velocity energy rises so that near the exit a major form of the energy is as velocity. In a normal fluid cyclone this velocity energy is lost and the outlet pressure is almost entirely from the mean pressure energy in the outlet area.

If the velocity energy were to be completely converted into pressure energy at the exit and friction losses were zero in the cyclone it could operate at any flow theoretically with no pressure drop. The velocity possible would be limited by the fact that the pressure could not fall below a vacuum of about 25 inches of mercury without having the space filled with water vapor. In practice, there are however losses of hydraulic energy by fluid friction which means less recovery of energy than that applied.

The tangential velocity and hence centrifuge force in the vortex of a cyclone is related to the pressure differential between the inlet and the average as the fluid leaves the central exit from the separating region. In the case of the conventional centrifuge with an air core this average on exit is somewhere between the core pressure and the exit pressure which has to be above atmospheric pressure, whereas with a pressure recovery design, which has a vacuum at the core, the average will again be somewhere between the core pressure and that of the outlet, but much nearer the core pressure. Thus, the operation of the conventional and velocity recovery units shown in the table below will have the same separation performance with inlet and outlet pressure shown compared in the table below.

| | PRESSURE P.S.I. | | | | | |
|---|---|---|---|---|---|---|
| | CONVENTIONAL | | | VELOCITY RECOVERY | | |
| PRESSURE DIFFERENCE | IN-LET | OUT-LET | CORE | IN-LET | OUT-LET | CORE |
| High | 50 | 5 | 0 | 40 | 10 | −15 |
| Low | 20 | 5 | 0 | 5 | 0 | −15 |

Figure 2:
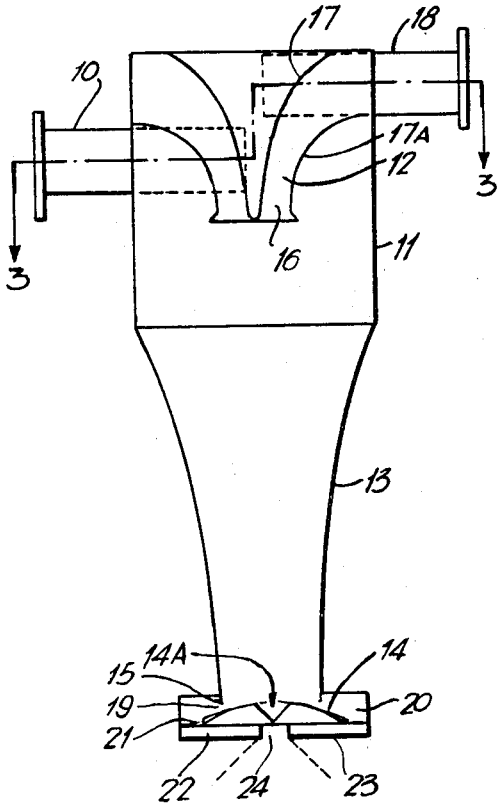
FIG. 2 is a similar view of a fluid cyclone provided in accordance with the present invention for recovery of velocity energy.
Figure 3:
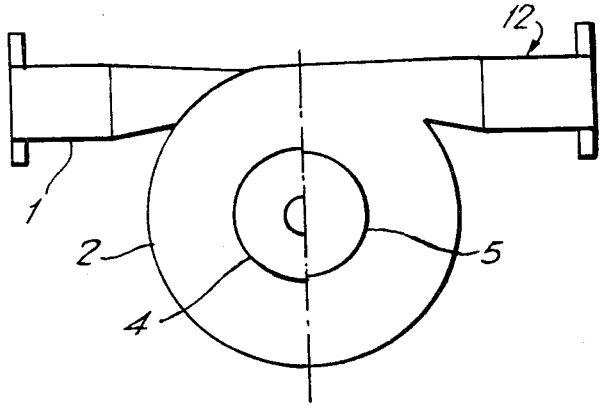
FIG. 3 is a cross-sectional view taken along line 3—3 of FIG. 2.

A fluid cyclone with recovery of velocity energy is illustrated in FIG. 2 wherein fluid to be treated enters by a tangential nozzle inlet 10 into a cylindrical section 11. Here it mixes with fluid which has come up from below, but not left the central exit opening 12. The mixture then follows a helical form of path downward to the cone 13 which is shown as a preferred curved form although a straight form would also function.

Any dense material is deposited by centrifugal force in the slower moving outer boundary layer. This layer travels quickly down the cone due to the differential pressure between differing radii resulting from centrifugal forces on the high speed fluid in the interior. The boundary layer material can be allowed to leave without the inner fluid by blocking the vortex with a blunt cone plate 14 while permitting the boundary layer fluid with its content of heavy material to leak away through a gap between the end 15 of the cone 13 and the blunt cone plate 14.

The main flow inside the boundary layer is turned back upward by the restriction of cone 13 and may either rejoin the downward stream in the cylindrical section 11 or leave by the central exit 12. The exit channel is an annular passage 16 between an inner cone 17 and an outer cone 17A providing a space which leads gently outward and expands in area. In the design shown this passage curves outward however, although this is the preferred design as the expansion of the path is gentlest where velocity is highest, straight cones would also serve some useful purpose. The fluid leaves by tangential outlet 18.

The gradual expansion in the exit passage and gradual increase in its radius leads to a conversion of both the axial and tangential velocity into pressure energy. Thus the unit can discharge to a much higher pressure than either at the core of the vortex or the mean pressure in the exit stream. With discharge to atmospheric pressure there will be a partial vacuum at the core yet the design shown will permit the flow out of the reject end to occur to atmospheric pressure.

The blunt cone plate 14 blocks the vortex at the bottom and a central depressure 14A in the blunt cone plate 14 stabilizes the core. The rejected fluid escaping from the gap 19 between cones 13 and 14 enters a cylindrical space 20 then passes downward past the edge of the blunt cone plate 14 and spaced apart support rods 21 into a space 22 between the bottom of the blunt cone plate 14 and a bottom plate 23. At this point the reject fluid will have considerable tangential velocity and pressure. As it passes the smaller radius towards a central exit 24 in plate 23, the tangential velocity will increase such that a vortex will exist between plate 23 and the underside of the cone plate 14. The reject fluid will emerge finally through the central hole 24 as a hollow cone spray. The pressure drop across the vortex on plate 23 will limit the rejection rate in selective fashion.

The pressure drop across a vortex occurs because of the centrifugal acceleration which acts on the mass of the fluid. The tangential velocity which causes this is dependent upon the initial tangential velocity of fluid entering the periphery of the vortex. If this fluid is a boundary layer fluid only, the velocity and hence throttling effect of the vortex will be low. If this fluid contains higher velocity liquid from the inner portion in cone 13, then the velocity and throttling effect of the reject vortex will be high.

The design is hence selective in rejecting the boundary layer fluid only. The depth of the boundary layer will depend upon its viscosity and will increas if it contains a high content of dense solids. This same increase in viscosity will cause losses in velocity of friction in the reject vortex on plate 23, thus reducing the throttling effect permitting it to pass a higher flow. This furthers the action of the reject system making it react automatically to varying loads of undersirable material in the fluid being treated.

Figure 4:
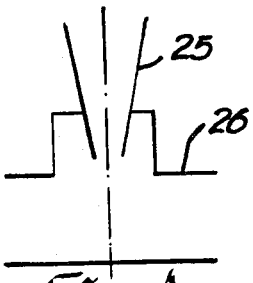
FIG. 4 is a partial elevational sectional view illustrating an alternate reject system.

Other arrangements may be made for removal of reject material. An extension of the cone, such as shown in FIG. 4 as 25, will throttle reject material and limit discharge. If this is left open to the atmosphere the pressure at the core of the cyclone must be also at atmospheric pressure. This may permit the fluid cyclone with velocity energy recovery to discharge to a pressure which may be useful in certain installations. Where this is not the case it may be preferable for this type of reject control to discharge rejects to a vacuum receiver 26.

In instances where the quantity of undersirable solids is extremely low they may be collected in a closed receiver. Thus the space between the orifice plate 23 (FIG. 2) and the bottom of the cone plate 14 may be replaced with a receiving chamber having a suitable mechanism for dumping the collected solids.

It is a known fact that smaller cyclones can remove finer particles than larger units. Experiments conducted by the applicant has also revealed that a smaller unit for the same design capacity has less loss of hydraulic energy by friction and hence more recoverable hydraulic energy. The applicant has also established through experiments that the simple tangential entry into a cylinder results in a great deal of loss of hydraulic energy and generation of turbulence. These studies have resulted in multiple arrangements of cyclone units by the applicant and which are illustrated in FIGS. 5 to 14. In the multiple units, multiple vortices are created directly in a header system in a stable arrangement. The arrangement may be considered identical to that of the stable pattern of vortex eddies which are created when a stream of fluid passes a fixed object and is known as a vortex trail. Vortices of opposite rotational sense progress in two lines. The spacing of the two lines normally would be 0.2806 times the spacing of individual vortices at each trail.

Figure 5:
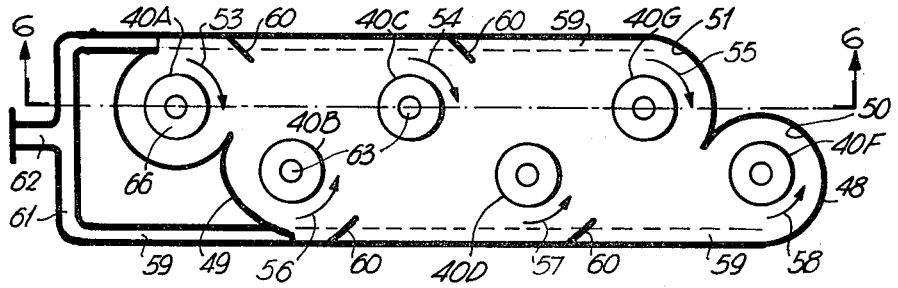
FIG. 5 is a horizontal sectional view taken along essentially 5—5 of FIG. 6 of fluid cyclones of conventional type mounted in a special arrangement in accordance with the present invention.
Figure 6:
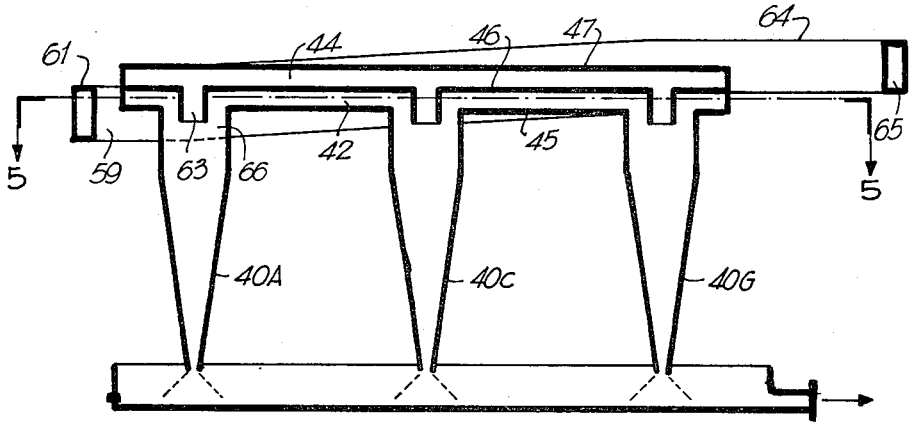
FIG. 6 is a vertical sectional view of the multiple cyclone of FIG. 5 taken along line 6—6 of FIG. 5.

Referring to FIGS. 5 and 6 there is illustrated six cyclone units 40A, 40B, 40C, 40D, 40E and 40F (only three appear in FIG. 6) that are of conventional design but provided with a novel inlet and outlet means. The inflow fluid to the cyclone units is from a common chamber 42 and the outflow into a common chamber 44. Chambers 42 and 44 are separate from one another and provided by spaced apart flat parallel plates 45, 46 and 47 interconnected by side walls and end walls. The chambers have respective opposite end walls 48 and 49, each of which have curved wall portions 50 and 51 interiorly of the chambers, such portions being preferably of spiral shape.

Cyclone units 40A, 40C and 40G are spaced apart from one another in a first row and cyclone units 40B, 40D and 40F are spaced apart from one another in the second row. The first and second rows are spaced apart from another and the cyclone units are staggered as best seen from FIG. 5. Cyclone units 40A, 40C and 40G have fluid rotation which appear from top view to rotate clockwise as indicated by arrows 53, 54 and 55 whereas units 40B, 40D and 40F have fluid rotation which appears from the top view to rotate counterclockwise as indicated by arrows 56, 57 and 58. The row of counter-rotating units is displaced by half the distance between units in the row direction and by approximately 0.28 times the distance between units sideways, thus placing the units in the pattern normally observed in a vortex trail. In this pattern, counter-rotating vortices are closest to each other and there is no frictional shear between them. The individual cyclone units acquire their fluid flow, not from individual tangential inlets, but by a general pattern of multiple vortices which is established in the space 42 between the parallel plates 45 and 46. The pattern of flow is established by two streams of constant velocity admitted by two channels 59, one to feed fluid into clockwise vortices 53, 54 and 55 and the other into counterclockwise vortices 56, 57 and 58. Fluid is diverted from the channels 59 at the appropriate angle and position to form the proper spiral vortex pattern by deflection plates 60 and the spiral containment end walls 50 and 51. The two feed channels 59 are joined by a passage 61 having an inlet 62 thereto through which the entering fluid is fed.

Fluid which enters the barrel of the cyclones leaves the cyclones by respective exit pipes 63 with a high rotational velocity into the space 44 between the plates 46 and 47. Although much of the rotational velocity is lost with the abrupt corner as shown, there will be reverse vortex flow in the space 44 in the tangential matrix in a similar sense to that in space 42 but with outward fluid flow movement. The fluid from the space 44 flows by way of two channels 64 interconnected by a passage 65 and discharged through a common outlet similar to inlet 62 illustrated in FIG. 5.

The heavy material rejected at the bottom exit of the fluid cyclones is shown as being collected in a pan 66 and discharged through an exit passage 67.

Figure 7:
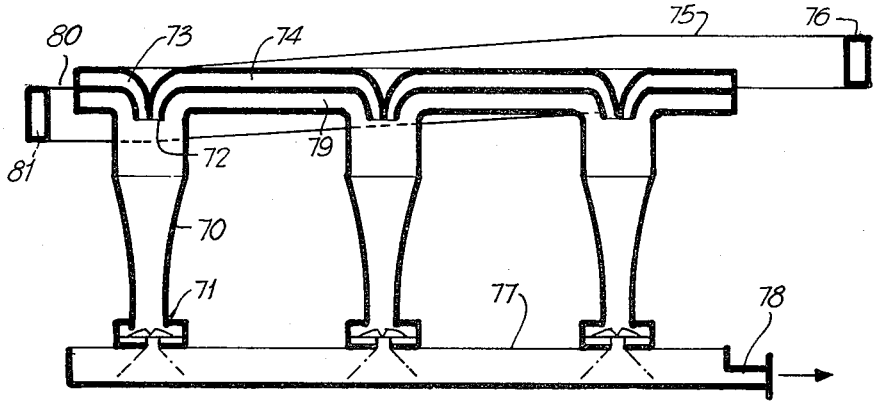
FIG. 7 is a view similar to FIG. 6 illustrating a reject system with cyclones of the type illustrated in FIG. 2.
Figure 8:
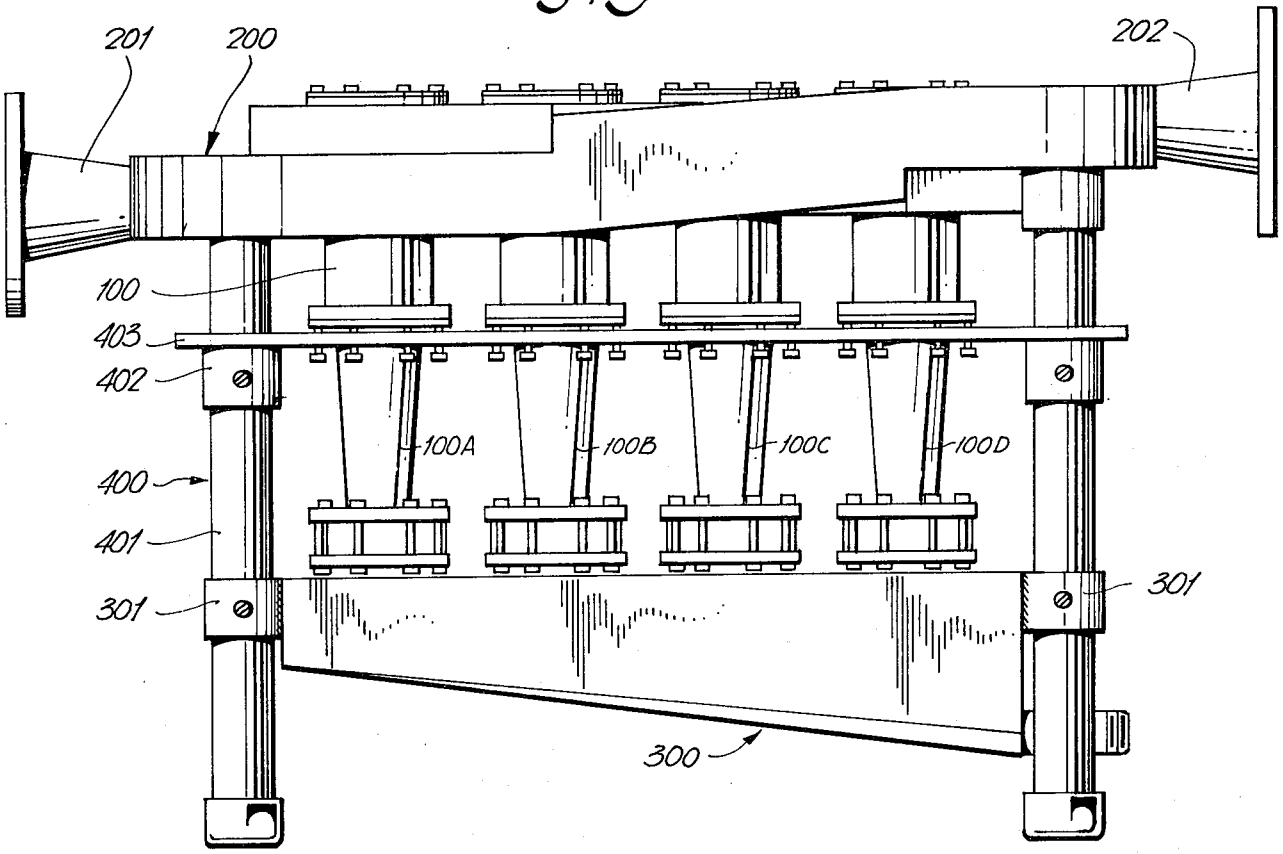
FIG. 8 is an elevational view of a multi-cyclone provided in accordance with the present invention.
Figure 10:
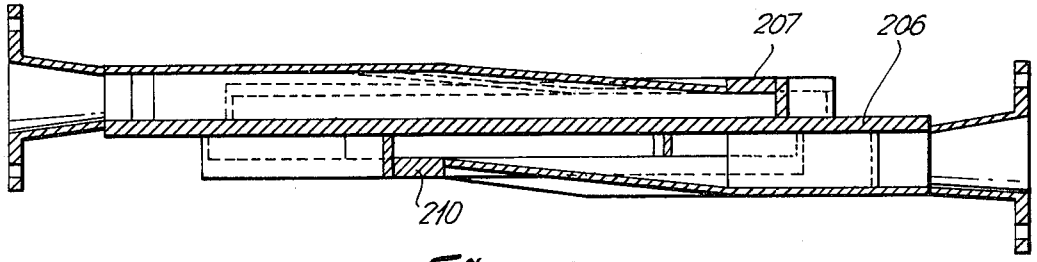
FIG. 10 is a sectional view taken along a stepped sectional line 10—10 of FIG. 11.
Figure 9:
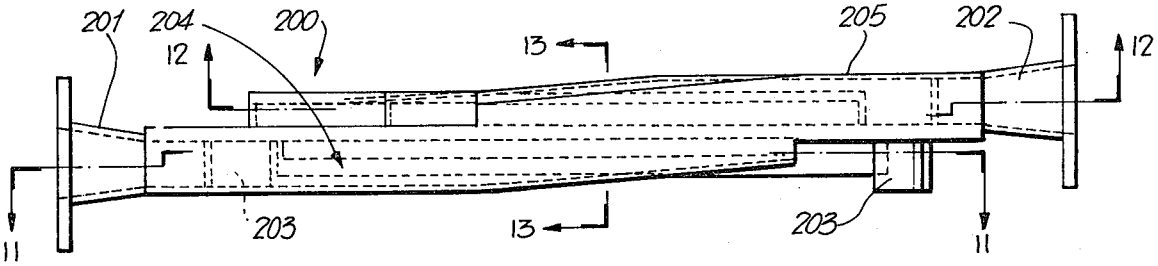
FIG. 9 is an elevational view of the upper header for the multi-cyclone of FIG. 8.

The embodiment illustrated in FIG. 7 is similar to that illustrated in FIGS. 5 and 6 and consists of a plurality of cyclone units 70 which are of the energy recovery type of FIG. 2. The energy recovery cyclones are arranged in the type of arrangement of FIG. 5 with the pattern of spiral vortices of a similar type created in the space between flat plates defining the chambers. The cyclones have conical and bottom end design 71 which is similar to that shown in FIG. 2 and an annular opening 72 for outflow of material from the cyclone. The annular outlet 72 leads to an expanding annular space 73 which in turn leads to space between the plates defining chamber 74. In this latter space the reverse spiral flow pattern described above with reference to FIGS. 5 and 6 occurs with fluid being collected by a pair of channels 75, only one of which is shown and which are interconnected by a passage 76 having an outlet therefrom (not shown) similar to inlet 62 illustrated and described with reference to FIG. 5. Reject materials are collected in a pan 77 and taken away by a pipe or other passage means 78.

Material to the respective cyclone units 70 is from a chamber 79 common to all of the units and having a pair of inlet passage means 80 (only one of which is shown) similar to the passages 59 described and illustrated with reference to FIG. 5. The pair of passages 80 are interconnected by a passage 81 having an inlet thereto (not shown) corresponding to inlet 62 illustrated and described with reference to FIG. 5.

Referring to FIGS. 8 to 14 inclusive, there is illustrated in more detail a practical embodiment of a multicyclone unit consisting of a plurality of individual cyclone units 100 having an inlet and outlet header system 200 on the upper end and a reject box 300 on the lower end, all of which are mounted on a supporting structure 400. The supporting frame consists of four vertical posts 401 rigidly connected by way of coupling members 402 to a horizontally disposed support plate 403. The reject box 300 is also rigidly connected to the legs 401 by way of bracket members 301, further rigidifying the entire structure.

The header 200 has an inlet 201 for fluids to be treated and an outlet 202. Details of the header 200 are illustrated in FIGS. 9 to 13 inclusive and reference will now be made thereto. The header 200 is a rigid assembly having four sockets 203 for receiving the upper ends of the frame posts 401, thereby mounting the header on the frame. Suitable locking means, for example set screws or the like, may be utilized in anchoring the header to the posts. The header 200 has a chamber 204 in which there is established a pattern of vortex flow such that the chamber serves as a common inlet for all of the cyclone units. Similarly there is a chamber 205 common to all of the individual cyclone units for the outflow of fluid from the cyclones. The inlet chamber 204 is defined by a central plate 206 and a lower plate 207 together with side plates 208 and 209. The outlet chamber is defined by the central plate 206 and upper plate 210 spaced therefrom and the side plates 208 and 209.

In referring to FIG. 11 there is located in the inlet chamber 204, a partition wall 212 that divides the inflowing fluid into two passages designated respectively 213 and 214. In the respective passages are diverter plates 215 and 216 secured to the central plate 206 and projecting downwardly therefrom toward the lower wall of the inlet manifold but spaced therefrom. The diverter plates 215 and 216 direct the inflowing fluid to form spiral vortices about the inlets of respective individual cyclone units 100A and 100B. Fluid flowing below the diverter plates 215 and 216 is directed to form spiral vortices about the respective individual cyclone units 100C and 100D. The curved end wall portions 221, 222, 223 and 224 serve as containment walls for the vortices at respective cyclone units 100A, 100B, 100C and 100D and as previously mentioned are preferably spirally shaped. The passages in outlet chamber 205 are shown in FIG. 12 which is a section taken along stepped line 12—12 in FIG. 9. The outlet from the individual cyclone units 100A, 100B, 100C and 100D is into chamber 205 and fluid flow therefrom is divided by partition wall 217 into passages 218 and 219 connected by way of passage 220 to the outlet 202.

Figure 14:
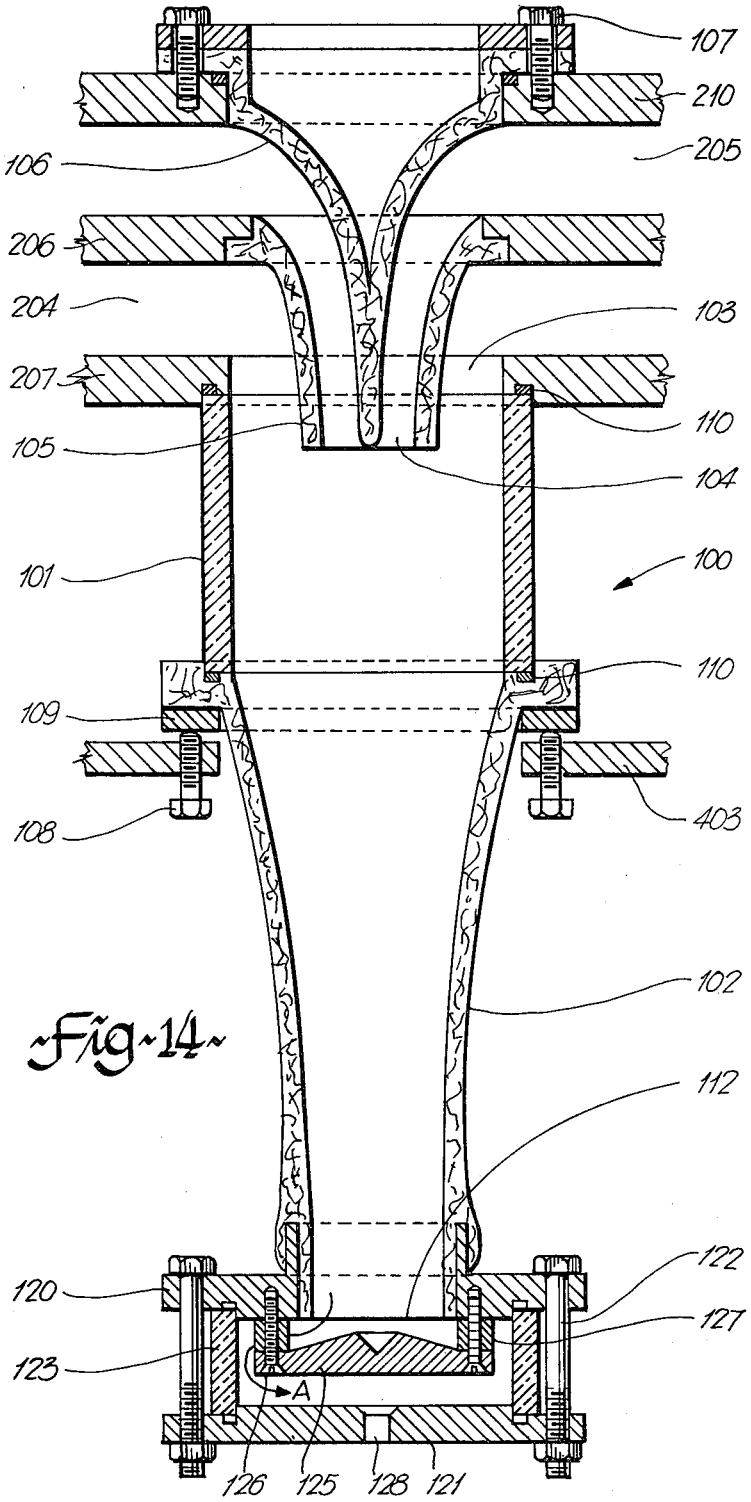
FIG. 14 is an enlarged cross-sectional view showing in detail one of the cyclones of the multi-cyclone unit.

A cross-section of an individual cyclone unit is illustrated in FIG. 14 and includes an upper cylindrical portion 101 followed by a lower tapered conical section 102. Inflow of fluid to be treated through chamber 204 enters the cyclone from the centre of the spiral vortex in said manifold by annular inlet passage 103. Outflow from the cyclone is through an annular passage 104, gradually increasing in size to the outlet chamber 205 where it spirals outward. The passage 104 is provided by truncated conical member 105 mounted on the intermediate plate 206 and a further conical member 106 projecting thereinto and mounted on the upper plate 210 by a plurality of bolts 107. The cylindrical portion 101 and tapered lower end portion 102 may be a single unit or, alternatively, separate units as illustrated, the cylindrical portion being provided by a short length of sleeve abutting at one end the lower manifold plate 207 and at the other end a flange on the tapered cone 102. A plurality of screws 108, threaded in the frame plate 403, press against an annular bearing ring 109 abutting the flange on member 102 and presses the cylindrical sleeve 101 against the manifold. O-ring seals 110 are provided to seal the joints.

The reject box 300 is mounted on the frame posts 401 at the lower reject outlet end of the cyclone. Between the reject box and mounted on the lower end of the conical portion are upper and lower plates 120 and 121 interconnected by a plurality of bolt and nut units 122 and held in spaced apart relation by a short sleeve 123. The lower end of the cone 102 is open as indicated at 112 and spaced therebelow is a cone plate 125. The cone plate 125 is mounted on the plate 120 by a plurality of machine screws 126 spaced apart from one another circumferentially around the cone plate. The cone plate is held in suitable spaced relation from plate 120 by spacers 127. Rejects from the cyclone follow the path indicated by the arrow A and discharge into the reject header box 300 by way of an aperture 128 in the lower plate 121.

Cyclones of the foregoing design are basically intended for use with water as the working fluid. The present design, however, is also deemed applicable when using gas as the working fluid; for example, treating gases from furnaces to remove fly ash and smoke.

There would, of course, be no phase discontinuity with gas in the cyclone, but the core pressure could also become subatmospheric with a design with pressure recovery. If the core pressure was low enough the gas near the core would expand thus increasing the velocity and become cold because of adiabatic expansion. The velocity of gases and hence the centrifugal force will be very much higher due to its lower density with an upper limit at the velocity of sound or approximately 1000 ft/second. This compares to a maximum theoretical possible velocity with water as the fluid, with 10 p.s.i. inlet and vacuum core of 60 ft. per second. The centrifugal accelerations at a radius of ½ inch with these tangential velocities would be 2683 times that of gravity for the water and 745,341 times that of gravity for the gas at the velocity of sound. In practice neither of these maximum velocities will be achieved because of friction in both devices. Gas cyclones are usually employed with only a few inches water gauge as a pressure differential. The velocity of sound can be achieved with 10 p.s.i. of air pressure. Atmospheric pressure is in excess of this so that very low friction loss and complete pressure recovery could achieve close to the velocity of sound in the gas near the core with a very low pressure differential across the unit.

A small multi-cyclone unit as described in the foregoing has been tested by the applicant for comparison in operability with air as opposed to water as the working fluid. In testing the unit to treat air, a fan was used to suck the air through the unit. The comparison makes the assumption that friction losses are proportional to velocity head whether one is dealing with air or water which is approximately true at very high Reynolds number. The following table shows comparative operation of the system on water and air:

COMPARSION 3" MULTICYLONE 4 UNITS

| | Water | Air |
|---|---|---|
| Inlet Pressure | 10 p.s.i. | Atmospheric |
| Outlet Pressure | 0 p.s.i. | −1" Water Gauge |
| Flow | 150 US gallon/min | 62 cubic ft/min |
| Mean Gravities | 315 | 975 |
| Mean Pressure at Outlet | 6" Hg Vacuum | −1.2" Water gauge |
| Core Pressure | 28" High Vacuum | 10" Hg Vacuum? |

In practice one would use much larger and more numerous cyclones to handle air at the low fan pressures used in the test. Hydraulic capacities are roughly proportional to the square root of the applied pressure differential. Mean gravities will be roughly proportional to the pressure differential. The mean pressure shown is in the fluid leaving the interior of the unit. The very center of the vortex will have a much lower pressure which in the case of water is filled with water vapour. The core condition with air is difficult to estimate due to expansion of the gas resulting in reduced density and temperature. The tests conducted, however, do establish applicability in the use of the multiple arrangement for not only liquids but gases.

I claim:

1. A header for a plurality of cyclones, said header having a first chamber with an inlet thereto and a plurality of outlets therefrom, said outlets being spaced apart from one another downstream from said inlet providing inlets to respective ones of a plurality of cyclones; and deflector means in said passageway to create a stable pattern of multiple vortices of flowing fluid in said chamber, said vortices being in contact with each other and consisting of a series of counter-rotating pairs located such that there is a vortex at each of said plurality of outlets.

2. A header as defined in claim 1 wherein said outlets are arranged one after the other downstream from the inlet along two lines and wherein the outlets in one line are staggered downstream relative to the outlets in the other line.

3. A device for directing fluid to and from a plurality of fluid cyclones comprising: first and second chambers separated from one another and providing respectively a common inlet to and common outlet from a plurality of individual cyclone units spaced apart from one another, an inlet to said first chamber, deflector means in said first chamber for establishing a stable pattern of a multiplicity of vortices in fluid flowing into said first chamber from the inlet thereto, said vortices being in contact with one another and consisting of a series of counter-rotating pairs, said vortices being equal in number to the number of individual cyclone units and at the respective locations thereof and an outlet from said second chamber.

4. A device as defined in claim 3 wherein said cyclone units are arranged in spaced apart rows with the cyclone units in one row offset in the direction of fluid flow with respect to the cyclone units in an adjacent row.

5. A device as defined in claim 4 wherein the vortices in the respective rows rotate in directions opposite to one another.

6. A device as claimed in claim 3 wherein the inlet to said first chamber comprises two parallel flow paths defined by respective first and second passageways, said flow paths being along opposite sides of the chamber and wherein said deflector means project partially into said passageways.

7. A cyclone arrangement comprising a plurality of individual cyclone units spaced apart from one another, header means detachably secured to the respective cyclone units for directing a flowing fluid to each of said plurality of fluid cyclones, said header means having a first chamber in fluid flow communication with respective ones of said cyclone units, deflector means in said first chamber for establishing a stable pattern of a multiplicity of vortices in fluid flowing in said first chamber, said vortices being in contact with each other and consisting of a series of counter-rotating pairs, said vortices being equal in number to the number of individual cyclone units and at the respective locations thereof and outlet means from said plurality of cyclone units.

8. A cyclone arrangement as defined in claim 7 wherein said cyclone units are arranged in spaced apart rows with the cyclone units in one row offset in the direction of fluid flow with respect to the cyclone units in an adjacent row.

9. A cyclone arrangement as defined in claim 8 wherein the vortices in the respective rows rotate in directions opposite to one another.

10. A cyclone arrangement as defined in claim 9 wherein fluid flow directing means includes two parallel flow paths, defined by respective first and second passageways, said flow paths being along opposite sides of the chamber and wherein said deflector means project partially into said passageways.

11. A device for directing fluid to and from a plurality of fluid cyclones comprising: first and second chambers separated from one another and providing respectively a common inlet to and outlet from a plurality of individual cyclone units spaced apart from one another, an inlet to said first chamber, deflector means in said first chamber for establishing a multiplicity of vortices in fluid flowing in said first chamber from the inlet thereto, said vortices being equal in number to the number of individual cyclone units and at the respective locations thereof and an outlet from said second chamber, said second chamber providing means for collecting fluid from said plurality of fluid cyclone units such that the swirling motion in the fluid leaving the cyclone units establishes a pattern of multiple vortices in a common space constituting said second chamber.

12. In a cyclone system a plurality of individual cyclone units spaced apart from one another and a header attached to the respective cyclone unts for supplying fluids thereto, said header comprising a first chamber providing a fluid space common to all of said cyclone units, fluid flow deflector means in said first chamber arranged such that the tangential velocity of fluid entering said cyclone units is provided by a stable pattern of multiple vortex flow in said fluid space common to all said cyclone units, said multiple vortex flow comprising a series of counter-rotating vortices in contact with one another, one being located at each of the respective cyclone units.

13. In a cyclone system as defined in claim 12 in which the number of cyclones is even with equal numbers with fluid rotating in opposing directions each being positioned adjacent to one or more cyclones with opposing direction of rotation.

14. In a cyclone system as defined in claim 13 in which the fluid cyclones with fluid rotation in a clockwise sense are spaced evenly in a first row whereas the equal number of fluid cyclones with fluid rotation in a counterclockwise sense are given the same spacing in a second parallel row displaced laterally by approximately 0.28 times the spacing of cyclone units in a row and in the row direction 0.5 times the spacing of the cyclone units in a row.

15. In a cyclone system for feeding fluid as well as removing fluid from multiple fluid cyclones as described in claim 14 in which pairs of conduits are placed outside and parallel to the adjacent counter rotating rows of cyclones, one of each pair being used for a given direction of vortex rotation.

16. In a cyclone system including a plurality of individual cyclone units, an arrangement for supplying fluids to said fluid cyclone units comprising a first chamber providing a fluid space common to all of said cyclone units, fluid flow deflector means in said chamber arranged such that the tangential velocity of fluid entering said cylone units is provided by a pattern of multiple vortex flow in said fluid space common to all said cylone units, and an arrangement for collecting fluid from said plurality of fluid cyclone units such that the swirling motion in the fluid leaving the cyclone units establishes a pattern of multiple vortices in a common space constituting a second chamber separate from said first chamber.

17. In a cyclone system including a plurality of individual cyclone units, an arrangement for supplying fluids to said fluid cyclone units comprising a first chamber defined by a space between a first plate and a second plate providing a fluid space common to all of said cyclone units, fluid flow deflector means in said chamber arranged such that the tangential velocity of fluid entering said cyclone units is provided by a pattern of multiple vortex flow in said fluid space common to all said cyclone units, and an arrangement for collecting fluid from said plurality of fluid cyclone units such that the swirling motion in the fluid leaving the cyclone units establishes a pattern of multiple vortices in a common space between said second plate and a third plate consitituting a second chamber separate from said first chamber.

* * * * *